US008038488B2

(12) United States Patent
Mukuno

(10) Patent No.: US 8,038,488 B2
(45) Date of Patent: Oct. 18, 2011

(54) FEMALE TERMINAL HARDWARE

(75) Inventor: Junichi Mukuno, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/849,844

(22) Filed: Aug. 4, 2010

(65) Prior Publication Data

US 2011/0045712 A1 Feb. 24, 2011

(30) Foreign Application Priority Data

Aug. 19, 2009 (JP) ..... 2009-190216

(51) Int. Cl.
*H01R 13/187* (2006.01)

(52) U.S. Cl. ..... 439/845

(58) Field of Classification Search ..... 439/845, 439/852, 854, 843, 790
See application file for complete search history.

(56) References Cited

U.S. PATENT DOCUMENTS 4,934,965 A * 6/1990 Buddrus et al. ..... 439/845
7,150,660 B2 12/2006 Allgood et al.
7,789,720 B2 * 9/2010 Zinn ..... 439/845

* cited by examiner

*Primary Examiner* — Javaid Nasri
(74) *Attorney, Agent, or Firm* — Gerald E. Hespos; Michael J. Porco

(57) ABSTRACT

A female terminal hardware (10) has a terminal main body (20) with a box-like terminal connecting section (21). A louver terminal (40) is housed in the terminal main body (20) and includes contact pieces (43) each juxtaposed in an inserting direction of a mating male terminal (TA). Contacting piece holding sections (45) hold the contact pieces (43). The terminal connecting section (21) has a terminal containing section (23) for housing the louver terminal (40) and with a louver terminal inserting aperture 25 for receiving the louver terminal (40). The louver terminal (40) is provided on a side area of the contact pieces (43) with a restraining section (51) that restrains the louver terminal (40) from being shifted and defines an inserting space for the male terminal (TA).

13 Claims, 15 Drawing Sheets

FEMALE TERMINAL HARDWARE

BACKGROUND OF THE INVENTION

1. Field of the Invention

This invention relates to a female terminal hardware.

2. Description of the Related Art

A female terminal hardware has a terminal main body and a louver terminal. The terminal main body has a box-like terminal connecting section and the louver terminal is held in the terminal main body by a holding portion. The louver terminal has contact pieces that extend in an inserting direction of a male terminal. The male terminal enters the terminal connecting section and slides on the contact pieces of the louver terminal to generate good electrical connection.

U.S. Pat. No. 7,150,660 shows a female terminal hardware with a terminal main body that includes a box-like receptacle corresponding to the above-described terminal connecting section. The receptacle has an open front and contains a separate louver spring beam corresponding to the above-described louver terminal. The louver spring beam has two beam arrays coupled to each other at a rear end by a central connecting portion so that the beam arrays can be deflected up and down.

The louver spring beam has inwardly contact pieces that extend in front and rear direction. A mating male terminal is inserted through the open front and into the receptacle along the front to rear direction. As a result, the male terminal expands the beam arrays and moves into the beam array while sliding on the louver spring beam to cause electrical connection between both terminals.

The central connecting portion that couples the beam arrays of the above-described female terminal hardware is on the rear end of the louver spring beam and must be disposed to avoid interfering with a distal end of the male terminal upon inserting the male terminal. Accordingly, the beam arrays must be elongated in the front and rear directions and hence the female terminal hardware is not easily downsized.

In view of the above problems, an object of the invention is to provide a female terminal hardware that can be downsized while maintaining good electrical connection.

SUMMARY OF THE INVENTION

The invention relates to a female terminal hardware with a terminal main body and a louver terminal. The terminal main body has a box-like terminal connecting section and the louver terminal is housed in the terminal connecting section. The louver terminal includes juxtaposed contact pieces that extend in an inserting direction of a mating male terminal and contacting piece holding sections for holding the contact pieces. The terminal connecting sections are provided with a terminal containing section for housing the louver terminal and with a louver terminal inserting aperture for receiving the louver terminal. The louver terminal has a retraining section on a side area of the contact pieces. The restraining section restrains the louver terminal from being shifted and defines an inserting space for the male terminal.

The disposition of the restraining section at the side area of the contact pieces assures that the distal end of the male terminal will not contact the restraining section, even if the male terminal is inserted into the terminal containing section so that the male terminal slides on the contact pieces. Accordingly, the louver terminal need not be elongated along the direction that receives the male terminal, and the female terminal hardware can be down sized while maintaining good electrical connection.

The louver terminal inserting aperture preferably is on the side area of the terminal connecting section in the inserting direction of the male terminal. Additionally, the restraining section is at the side of the louver terminal inserting aperture when the louver terminal is inserted into the terminal connecting section. Thus, the restraining section can prevent foreign particles from entering the louver terminal inserting aperture.

Projections are on a portion of an inner wall of the terminal connecting section on which the louver terminal is not disposed and lie on both side areas of the louver terminal. The projections extend along the inserting direction of the louver terminal. The projections extend perpendicular to the inserting direction of the male terminal and prevent the male terminal from being twisted during insertion.

The louver terminal includes the contact pieces and two opposed contact piece holding sections for holding the contact pieces. The restraining section connects the two contact piece holding sections to each other. The contact pieces can contact upper and lower sides of the male terminal to obtain a greater contact area between the male terminal and the contact pieces in comparison with the case where the contact pieces contact only one side of the male terminal. The restraining section couples the contact piece holding sections to simplify a structure of the louver terminal.

Convex steps are provided on the inner wall of the terminal connecting section and the louver terminal is provided with latches to be engaged with the steps. Thus, it is possible to latch the louver terminal in the terminal connecting section.

DETAILED DESCRIPTION OF THE PREFERRED EMBODIMENTS

A female terminal hardware in accordance with the invention is identified by the numeral 10 in FIGS. 1 to 15. The female terminal hardware 10 is crimped on and secured to an end of a coated electrical cable. The coated electrical cable is arranged between devices (not shown) such as batteries, inverters and motors that constitute power sources for driving an electrical motor vehicle. Hereinafter, a vertical direction designates upper and lower sides in FIG. 1, a front end designates a left side and a rear end designates a right side in FIG. 1.

Figure 1:
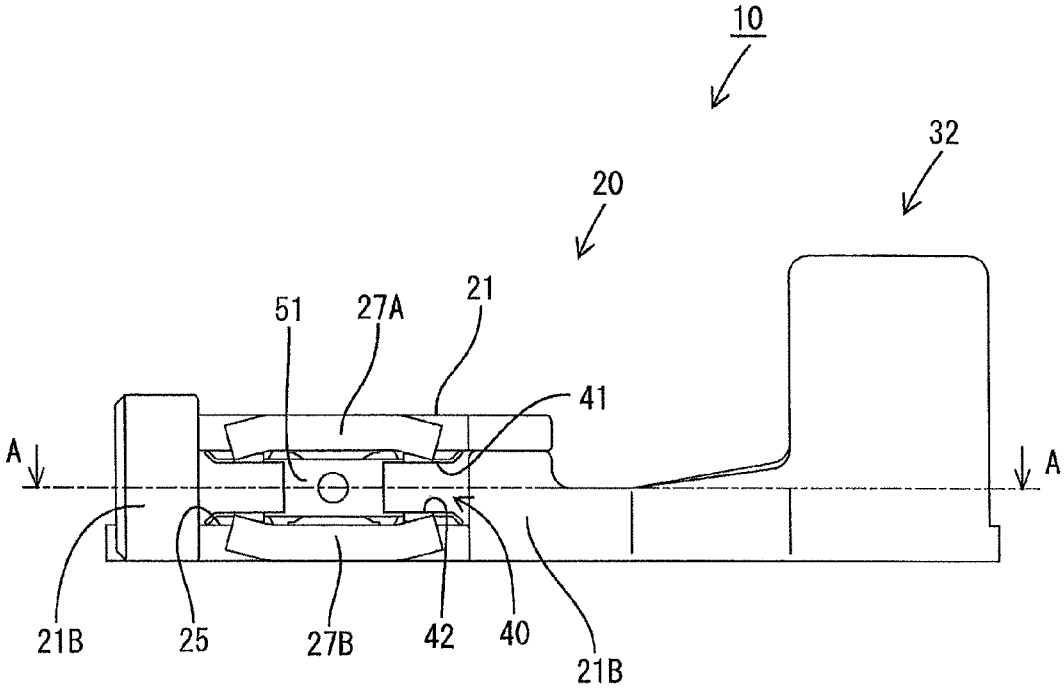
FIG. 1 is a side elevation view of a first embodiment of a female terminal hardware in accordance with the present invention.
Figure 2:
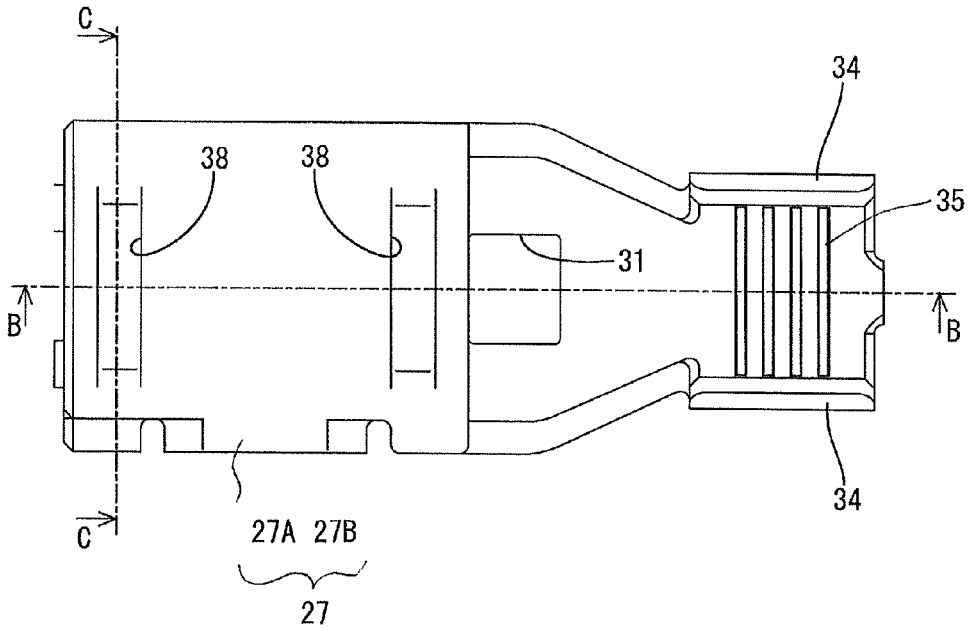
FIG. 2 is a top plan view of the female terminal hardware shown in FIG. 1.
Figure 14:
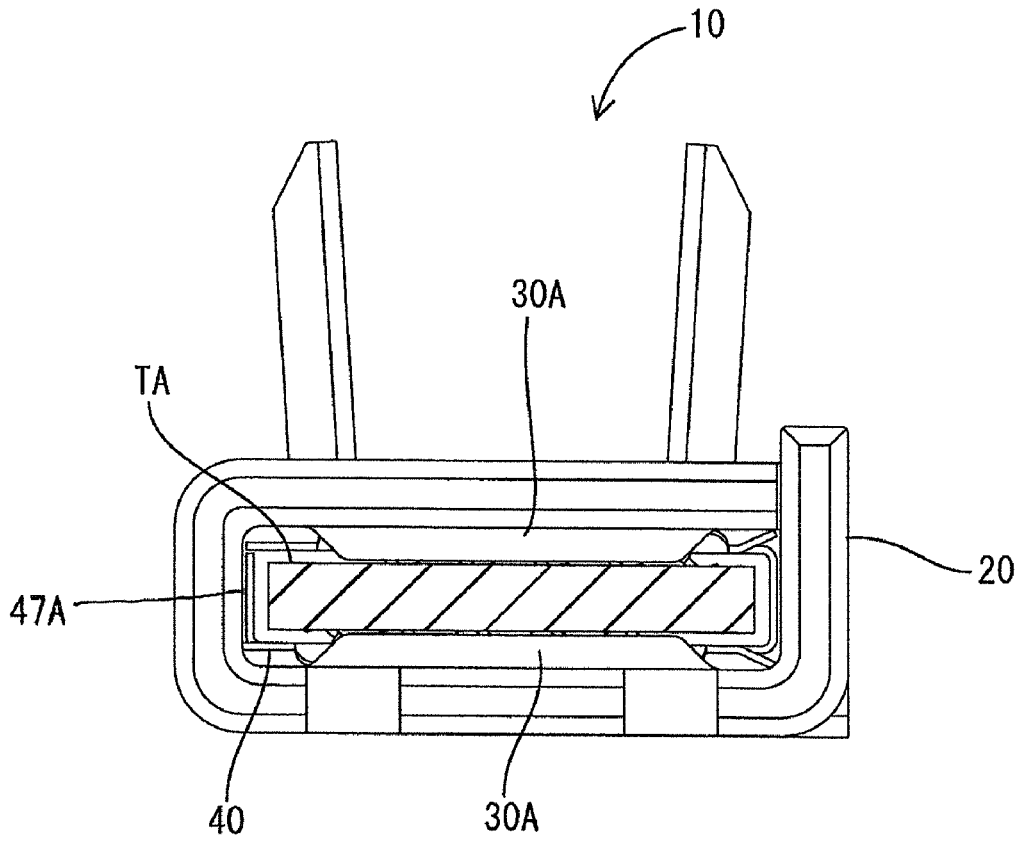
FIG. 14 is a cross section view similar to FIG. 12, illustrating a state in which a male terminal is coupled to the female terminal hardware.

As shown in FIG. 1, the female terminal hardware 10 includes a terminal main body 20 and a louver terminal 40. The louver terminal 40 is contained in the terminal main body 20 and is connected to a mating male terminal TA (FIG. 14).

The terminal main body 20 is made of copper or copper alloy and includes a box-like terminal connecting section 21 and an open barrel shape electrical cable connecting section 32.

Figure 3:
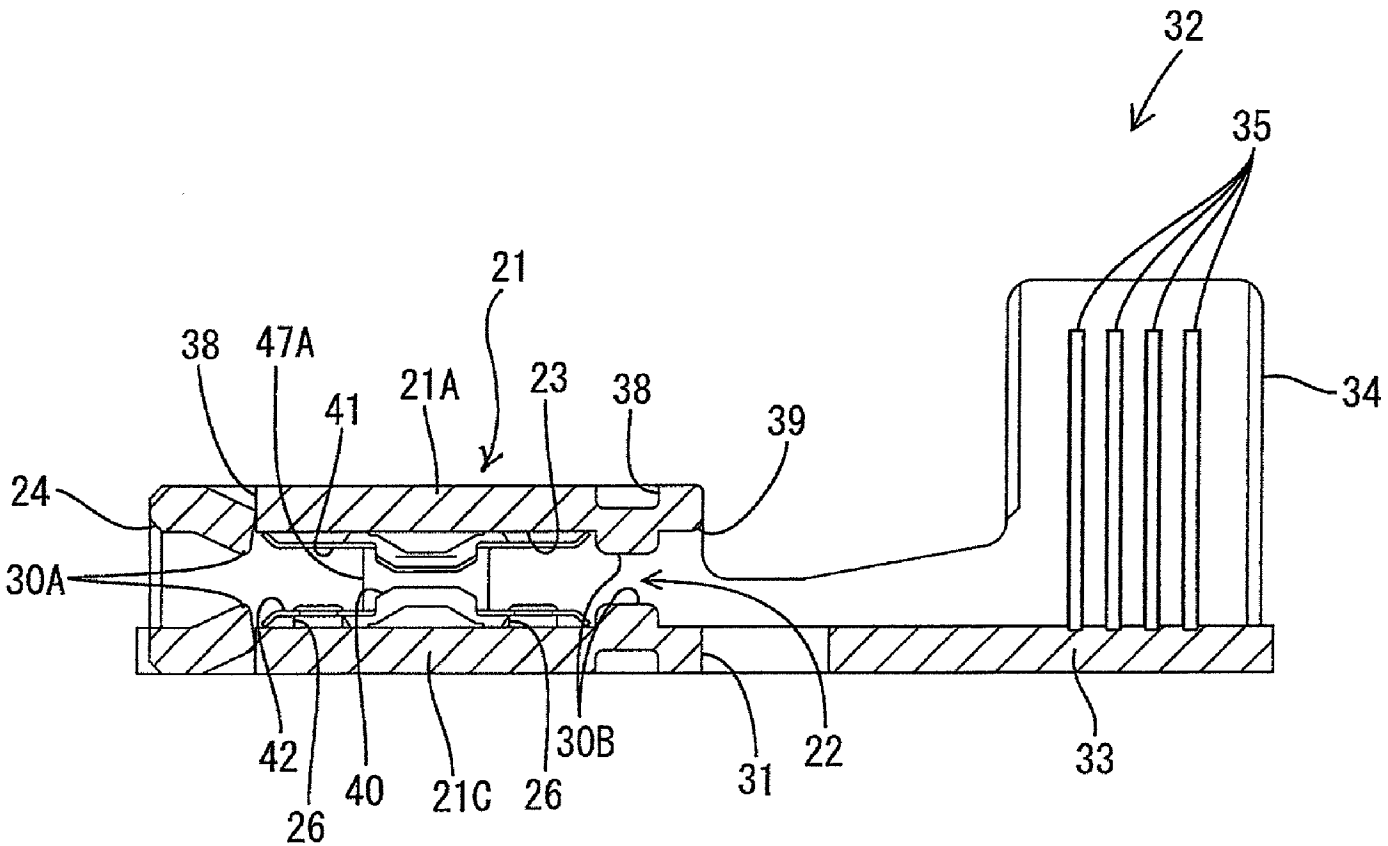
FIG. 3 is a longitudinal section view of the female terminal hardware taken along lines B-B in FIG. 2.

As shown in FIG. 3, the terminal connecting section 21 is an elongate rectangular tube with front and rear openings 24 and 39. The front opening 24 defines a wide rectangular connecting aperture for receiving the mating male terminal TA.

A communicating space 22 is defined in the terminal connecting section 21 and communicates with the openings 24 and 39. A terminal containing section 23 is defined in an intermediate part of the communicating space 22 for housing a louver terminal 40.

Figure 4:
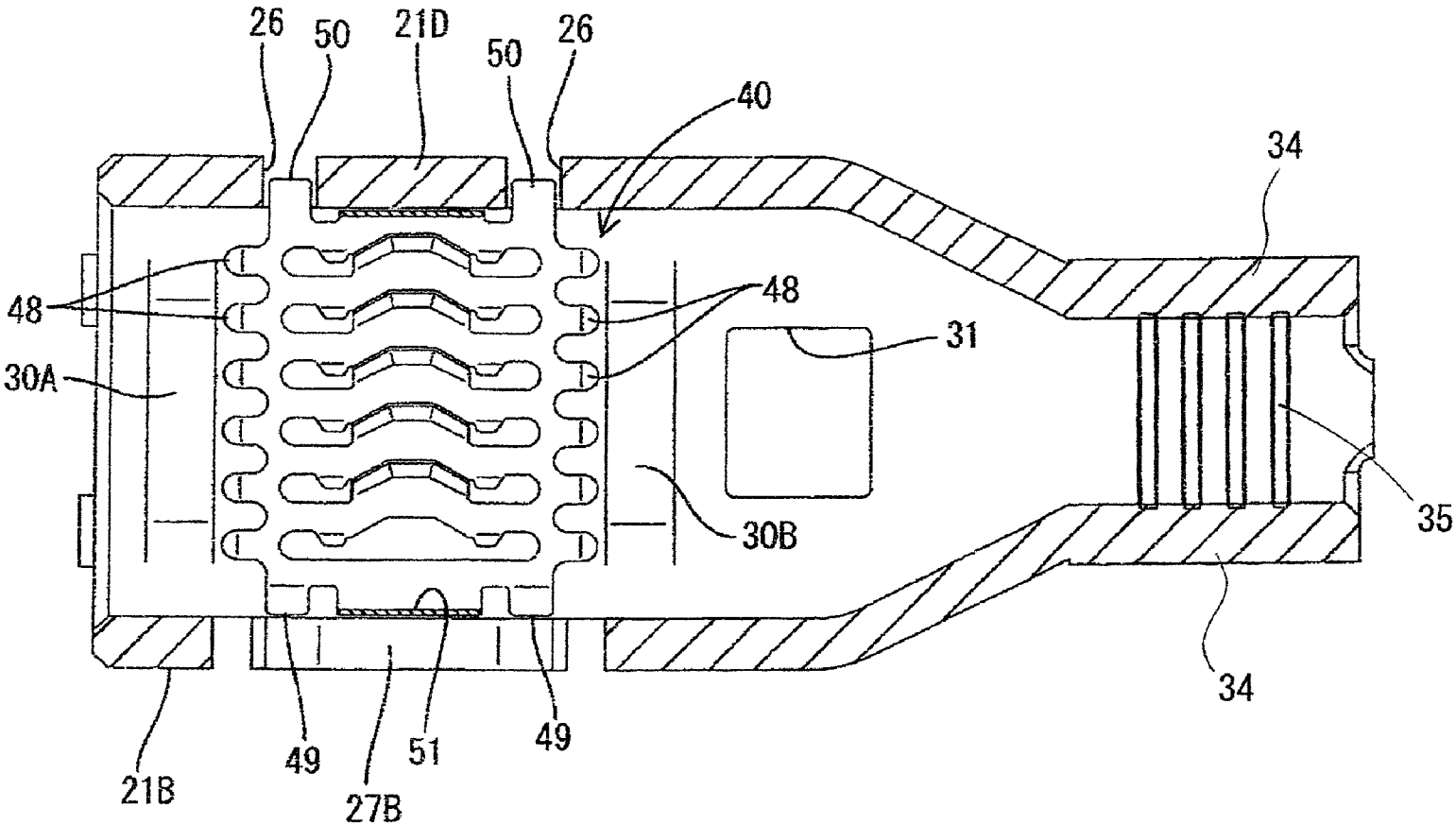
FIG. 4 is a longitudinal section view of the female terminal hardware taken along lines A-A in FIG. 1.
Figure 5:
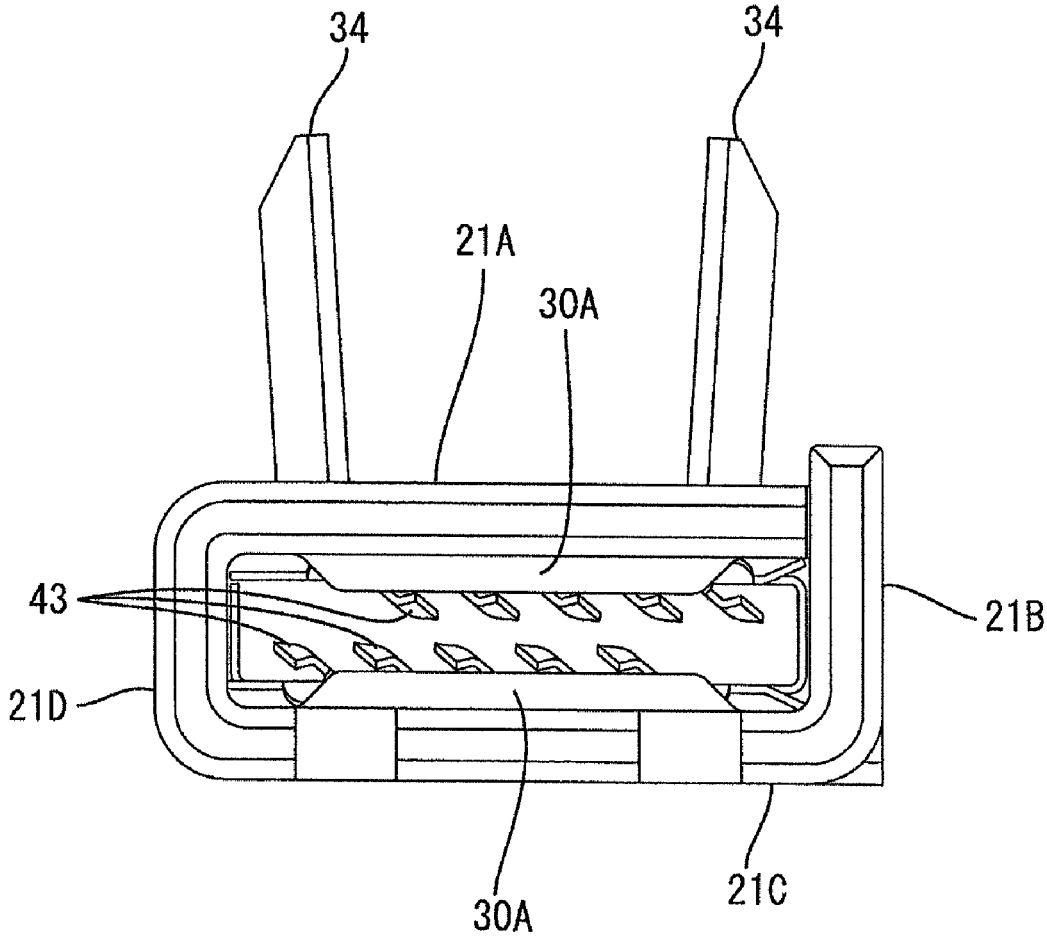
FIG. 5 is a front side view of the female terminal hardware shown in FIG. 1.
Figure 6:
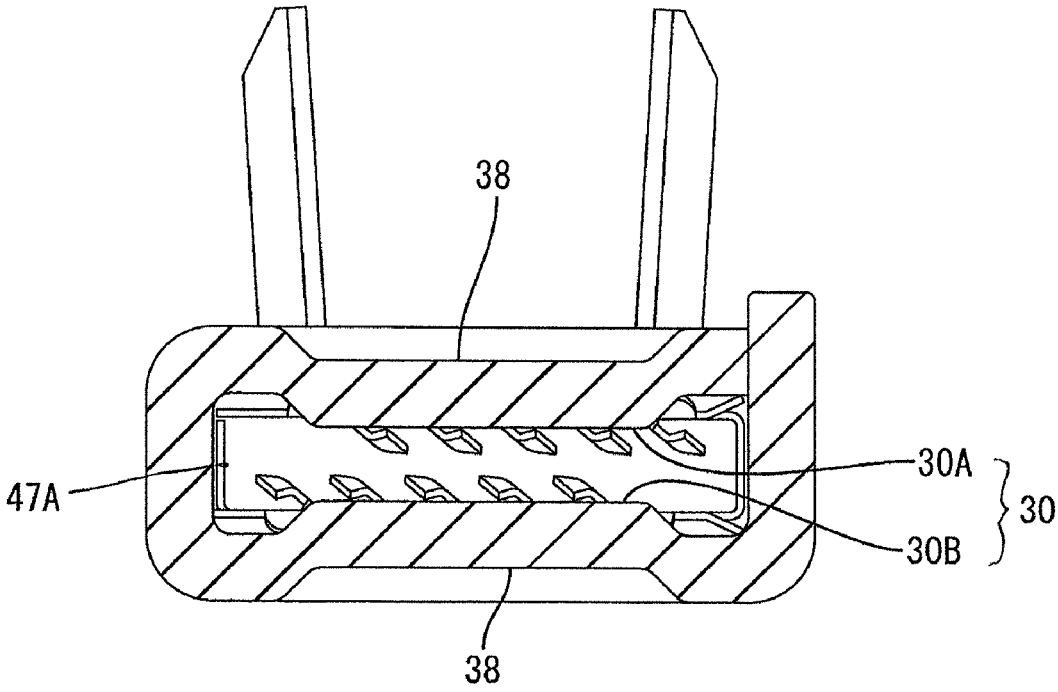
FIG. 6 is a cross section view of the female terminal hardware taken along lines C-C in FIG. 2.
Figure 12:
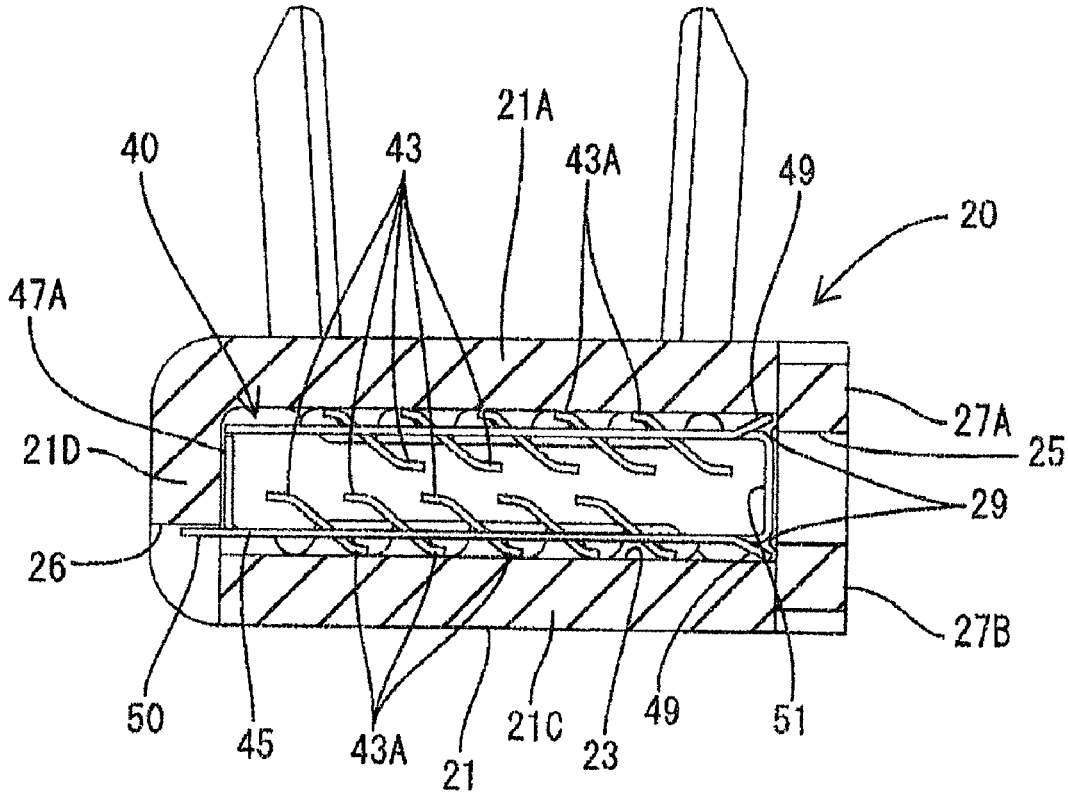
FIG. 12 is a cross section view similar to FIG. 10, illustrating the louver contained in the terminal main body completely.

The terminal connecting section 21 has opposite left and right side walls 21B and 21D. A long rectangular louver terminal inserting aperture 25 is formed in the left side wall 21B and is configured for receiving the louver terminal 40, as shown in FIG. 1. The left side wall 21B is cut off at an intermediate part. The right side wall 21D of the terminal connecting section 21 has two positioning apertures 26 spaced apart in the front and rear directions, as shown in FIG. 4. The positioning apertures 26 are formed by cutting off lower ends of the right side wall 21D, as shown in FIG. 12, so that areas outside of the terminal connecting section 21 communicate with the terminal containing section 23.

Figure 7:
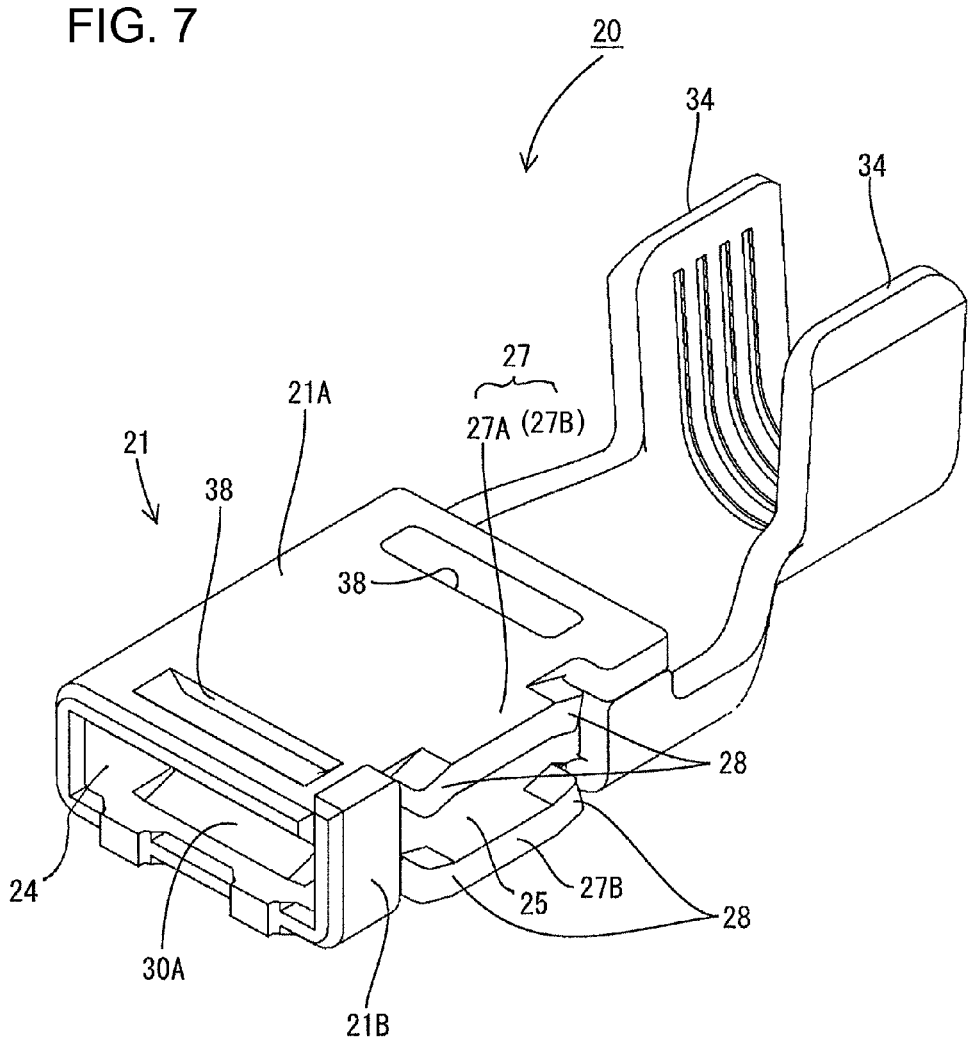
FIG. 7 is a perspective view of a terminal main body shown in FIG. 1.
Figure 8:
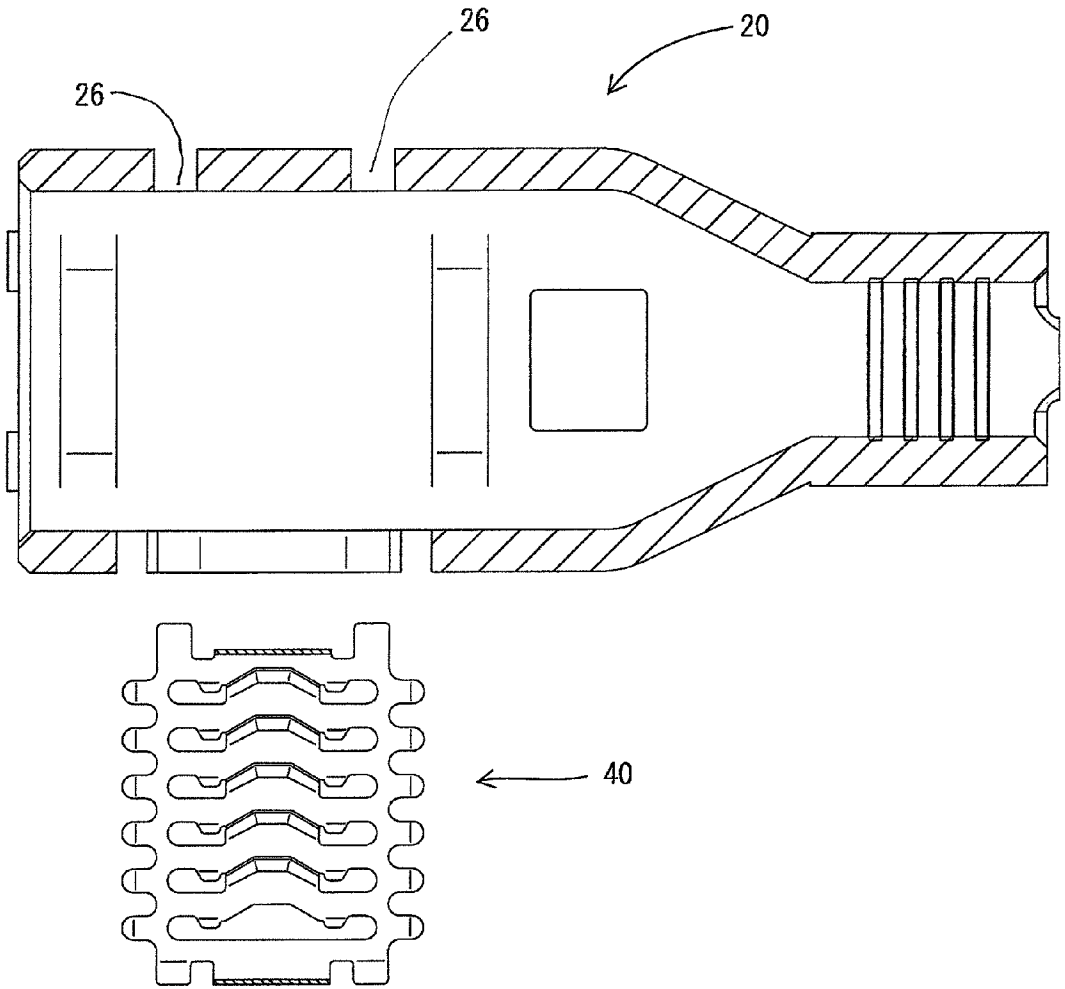
FIG. 8 is a longitudinal section plan view of the terminal main body, illustrating the terminal main body in a state before a louver terminal is inserted into the terminal main body.

Upper and lower walls 21A and 21C extend between the side walls 21B and 21D, as shown in FIGS. 3 and 7. Extensions 27A and 27B extend from the upper and lower walls 21A and 21C at the louver terminal inserting aperture 25 in the left side wall 21B. The extensions 27A and 27B protrude to an outer surface of the left side wall 21B.

Slants 28 are provided on the front and rear ends of the extensions 27A and 27B and incline in toward the louver terminal inserting aperture 25. The slants 28 are stepped with respect to the flat upper and lower walls 21A and 21C. As shown in FIG. 12, steps 29 are provided on boundary areas between the slants 28 and inner surfaces of the upper and lower walls 21A and 21C. The steps 29 protrude in to the side of the louver terminal inserting aperture 25. The steps 29 engage the louver terminal 40 to hold the louver terminal 40 in the terminal containing section 23.

Projections 30A and 30B are formed on portions of the upper and lower walls 21A and 21C near the front and rear ends of the terminal containing section 23 and project toward the communicating space 22, as shown in FIG. 3.

The projections 30A and 30B define the front and rear boundaries of areas of the communicating space 22 that form the terminal containing section 23. Heights of the projections 30A and 30B are substantially constant and their lengths extend on the inner surfaces of the upper and lower walls 21A and 21C in the entire width direction. The projections 30A and 30B restrain the louver terminal 40 from being moved front and rear in the connecting and disconnecting directions of the male terminal TA. The projections 30A and 30B guide the louver terminal 40 inserted into the terminal containing section 23.

Outer surfaces of the upper and lower walls 21A and 21C are provided with recesses 38 that receive the projections 30A and 30B.

A rectangular aperture 31 is provided in the lower wall 21C rearward of the projection 30B (FIG. 4).

The electrical cable connecting section 32 includes a bottom plate 33 that extends back from the lower wall 21C of the terminal connecting section 21, as shown in FIG. 3. An intermediate part of the bottom plate 33 in a width direction (FIG. 7) is concave and an end of the coated electrical cable is disposed on the bottom plate 33.

Wire barrels 34 extend from opposite sides of the bottom plate 33 in the width direction and are crimped onto the core wire exposed from an end of the coated electrical cable to press-contact wire barrels 34 with the core wire.

Serrations 35 extend in the width direction along the wire bottom plate 33 and continue to the wire barrels 34. The serrations 35 strip an oxide film around the core wire upon crimping.

The female terminal hardware 10 is formed by punching a metallic sheet into a developed pattern and bending the developed pattern. The projections 30A and 30B and slants 28 can be formed by punching and pressing.

Figure 13:
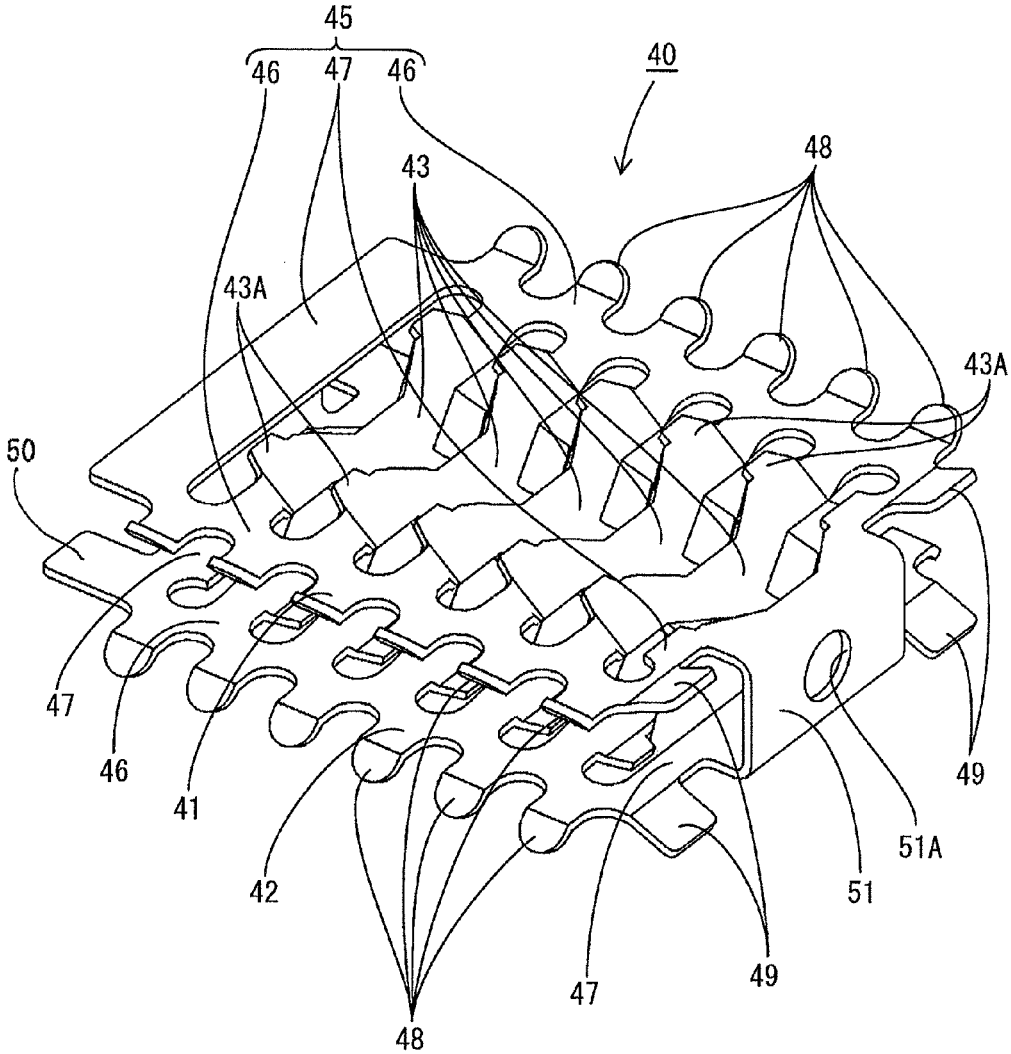
FIG. 13 is a perspective view of the louver terminal.

The louver terminal 40 is made of a material (for example, beryllium copper) having higher elasticity than the terminal main body 20. As shown in FIG. 13, the louver terminal 40 has two opposed contact plates 41 and 42 and a restraining section 51 that couples the contact plates 41 and 42 and restrains the louver terminal 40 from shifting to define an inserting space for receiving the male terminal TA.

The contact plates 41 and 42 include five contact pieces 43 juxtaposed in a width direction and contact piece holding sections 45 for coupling and holding ends of the contact pieces 43 to one another.

Each contact piece 43 has a contact portion bent toward each of the horizontal contact piece holding sections 45 so that intermediate parts in the front and rear directions protrude inward. Opposite sides of each contact piece 43 define a contact portion 43A extending out to the contact piece holding section 45. Thus, the contact pieces 43 of the contact plates 41 and 42, as seen in an inserting direction of the male terminal TA, are inclined in substantially the same direction and define an inserting space narrower than a thickness of the male terminal TA between the upper and lower contact pieces 43, as shown in FIG. 12.

As shown in FIG. 13, each of the contact piece holding sections 45 defines a frame-like configuration that surrounds five contact pieces 43. Each contact piece holding section 45 includes a contact piece coupling 46 for connecting adjacent contact pieces 43 to one another, and side couplings 47 for connecting the contact piece coupling portions 46 at sides of the contact pieces 43.

Each contact piece coupling 46 has contact pieces 48 that slant in an upper direction to contact with a wall surface of the terminal containing section 23 at every part for coupling the adjacent contact pieces 43 to one another.

The side coupling 47 at the side of the restraining section 51 has two latches 49 that engage the steps 29 of the terminal connecting sections 21 to position the louver terminal 40. The latches 49 are disposed on opposite sides of the restraining section 51 and slant outward.

Positioning projections 50 (FIGS. 12 and 13) protrude horizontally from the lower contact plate 42 at an end of the side coupling 47 opposite the restraining section 51 and hence at an inner part in the inserting direction of the louver terminal 40. The positioning projections 50 are disposed in the positioning apertures 26 of the terminal connecting portion 21 to position the louver terminal 40 in the front and rear directions, which define the attaching and detaching directions of the male terminal TA.

Figure 9:
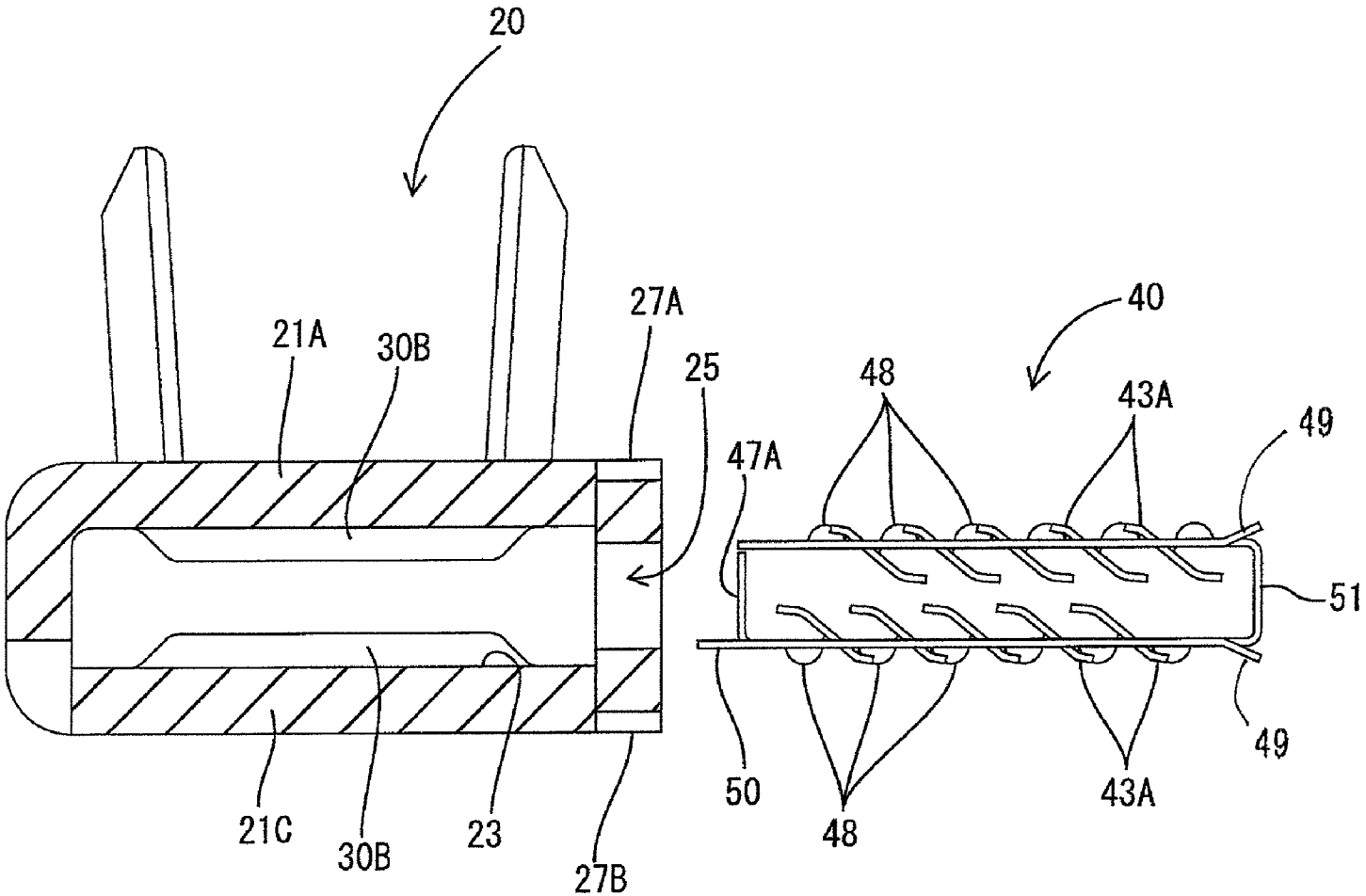
FIG. 9 is a cross section view of the terminal main body shown in FIG. 8, illustrating the terminal main body in the state before the louver terminal is inserted into the terminal main body.
Figure 10:
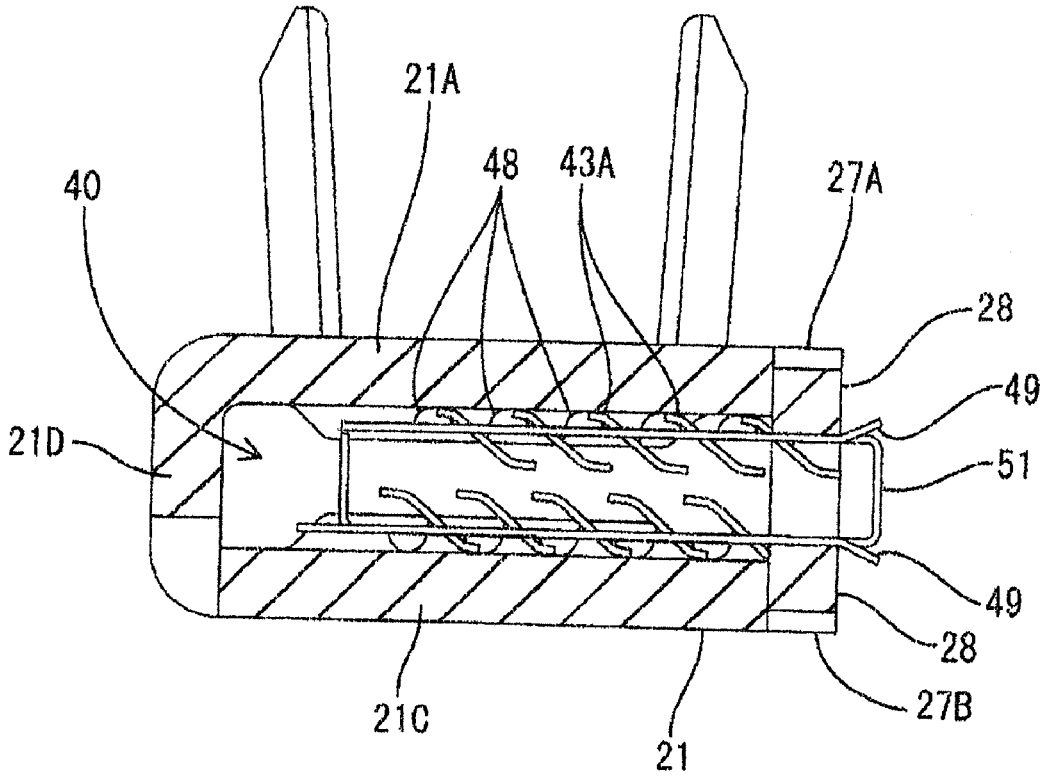
FIG. 10 is a cross section view similar to FIG. 9, illustrating a state in which latch pieces of the louver terminal contact with extended portions of the terminal main body when the louver terminal is inserted into the terminal main body.

A deflection restraining piece 47A stands vertically up from the side coupling 47 that has the positioning projection 50 on the end on the lower contact plate 42, as shown in FIG. 9. The deflection restraining piece 47A and the restraining section 51 have substantially equal heights. An upper end of the deflection restraining piece 47A is immediately below the inner part of the upper contact plate 41 in its inserting direction. The deflection restraining piece 47A restrains the contact plates 41 and 42 from being deflected around the restraining section 51 in an inward direction.

The restraining section 51 couples intermediate parts of the side couplings 47 of the upper and lower contact plates 41 and 42 at a side of the louver terminal inserting aperture 25. That is, the restraining section 51 is at a side area of the juxtaposed contact pieces 43 (in an arranging direction of the contact pieces 43). A height of the restraining section 51 is set so that the contact pieces 48 of the upper and lower contact plates 41 and 42 contact with the upper and lower walls 21A and 21C. Thus, the louver terminal 40 is restrained from being shifted up and down and the inserting space for the male terminal AT is defined between the upper and lower contact plates 41 and 42. A circular through-hole 51A is formed in a central part of the restraining section 51.

As shown in FIG. 9, the louver terminal 40 is inserted into the louver terminal inserting aperture 25 with the positioning projection piece 50 in the lead.

The contact portions 43A of the contact pieces 48 and 43 are juxtaposed in the inserting direction and move into the terminal containing section 23 while sliding on the inner surfaces of the upper and lower walls 21A and 21C, respectively. At this time, the projections 30A and 30B on the upper and lower walls 21A and 21C guide the contact pieces 48 at the front and rear sides, thereby restraining the louver terminal 40 from being shifted in the inserting direction.

Figure 11:
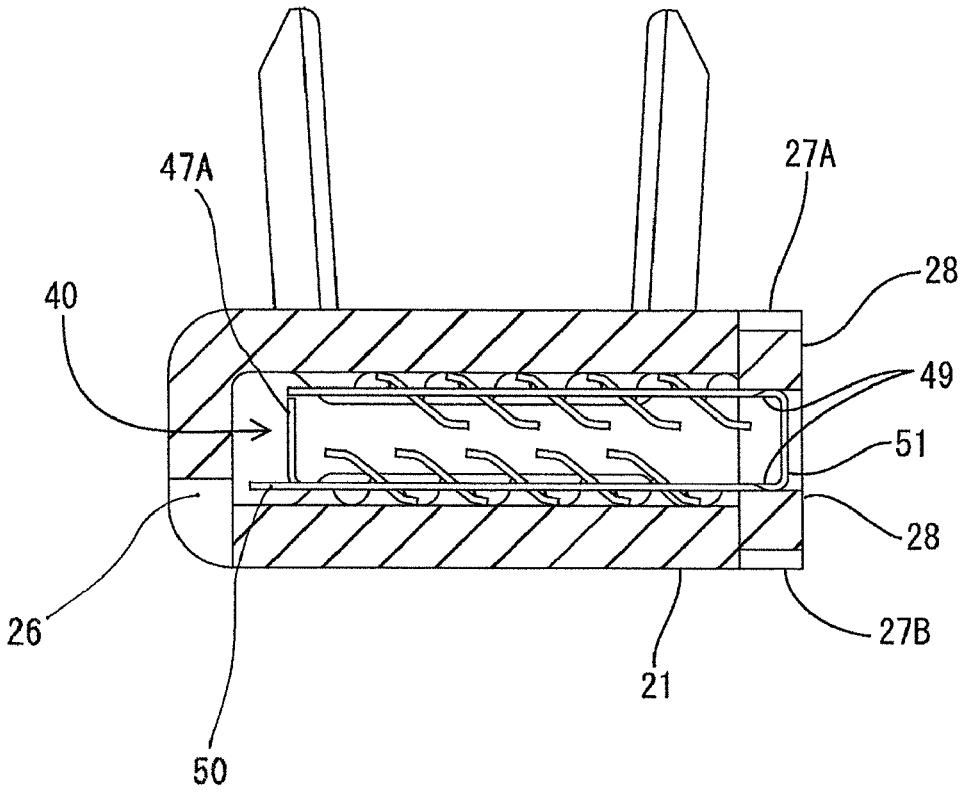
FIG. 11 is a cross section view similar to FIG. 10, illustrating the latch pieces in a deflected state when the louver terminal is inserted into the terminal main body.

The latches 49 of the louver terminal 40 contact edges of the slants 28 on the upper and lower extensions 27A and 27B (FIG. 10), and hence the latch pieces 49 deflect (FIG. 11).

As shown in 12, the positioning projection pieces 50 at a distal end of the louver terminal 40 are inserted into the positioning apertures 26 in the terminal main body 21, and the latches 49 at the rear side reach the steps 29 to return to the original state. Thus, the rear side part of the louver terminal 40 in the inserting direction engages the steps 29 to hold the louver terminal 40 in the terminal containing section 23.

As shown in FIG. 14, the mating male terminal TA is inserted into the connecting aperture 24 (FIG. 3) in the terminal main body 20 and passes through the space between the upper and lower projections 30A and 30B at the front of the terminal containing section 23. Thus, the male terminal TA is disposed between and slides on the contact pieces 43, and the leading end of the male terminal TA moves into a space between the rear projections 30A and 30B of the terminal containing section 23.

Figure 15:
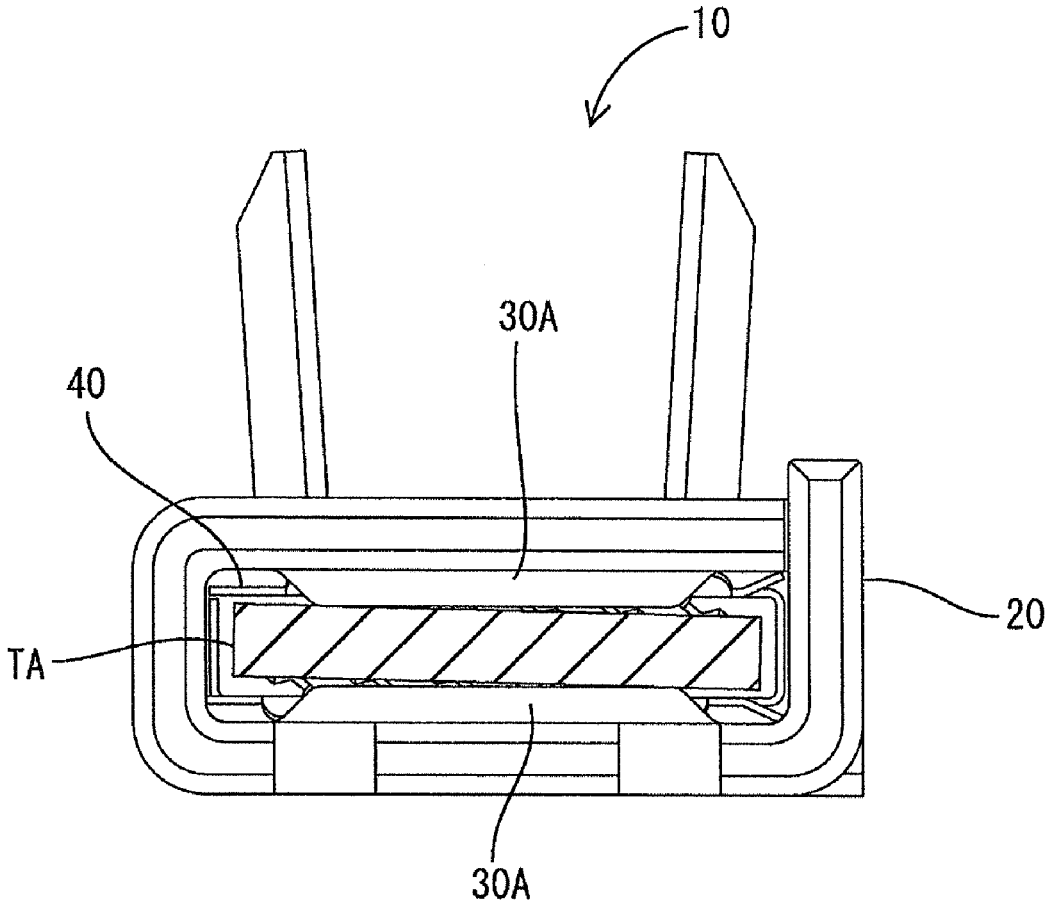
FIG. 15 is a cross section view similar to FIG. 14, illustrating a state in which the male terminal is twisted in the female terminal hardware.

As shown in FIG. 15, a clearance between the projections 30A and 30B on the upper and lower walls 21A and 21C and the male terminal TA is very small. Thus, the male terminal TA will not twist during insertion.

The restraining section 51 is at the side of the contact pieces 43. Thus, the distal end of the male terminal TA cannot contact the restraining section 51 as the male terminal TA is inserted into the terminal containing section 23 and slides on the contact pieces 43. Accordingly, it is not necessary to elongate the louver terminal 40 according to a length of the male terminal TA to be received in the louver terminal 40, and the female terminal hardware 10 can be down sized while maintaining good electrical connection.

The louver terminal inserting aperture 25 is on the side area of the terminal connecting section 21. The restraining section 51 is at the side area of the louver terminal inserting aperture 25. Thus, the restraining section 51 can prevent foreign particles from entering the louver terminal inserting aperture 25.

The projections 30A and 30B extend along the inserting direction of the louver terminal 40A on a portion of an inner surface of the terminal connecting section 21 on which the louver terminal 40 is not disposed. The projections 30A and 30B extend in a direction perpendicular to the inserting direction of the male terminal TA and prevent the male terminal TA from being twisted during insertion. The projections 30A and 30B also guide and position the louver terminal 40.

The louver terminal 40 has the contact pieces 43 and contact piece holding sections 45 for holding the contact pieces 43. The restraining section 51 connects the opposed contact piece holding sections 45. The contact pieces 43 contact the upper and lower sides of the male terminal TA and obtain a greater contact area between the male terminal TA and the contact pieces 43 in comparison with the case where the contact pieces 43 contact only one side of the male terminal TA. The restraining section 51 couples the contact piece holding sections 45 to each other, thereby simplifying a structure of the louver terminal 40.

The convex steps 29 are provided on the inner wall of the terminal connecting section 21 and the louver terminal 40 has latches 49 that engage the steps 29. Thus, the louver terminal 40 is latched in the terminal connecting section 21.

It should be noted that the invention is not limited to the embodiment described above by referring to the drawings. For example, the following embodiments will be fallen into the technical scope of the present invention.

The louver terminal 40 need not be inserted from the side into the louver terminal inserting aperture 25 on the side surface of the terminal main body 20. For example, the louver terminal 40 may be inserted into the terminal inserting aperture 25 from the front of the terminal main body 20. In this case, the louver terminal 40 may be inserted into the terminal main body 20 from the connecting aperture 24 provided on the front end of the terminal main body 20 to insert the male terminal TA. Since the restraining section 51 is disposed on the side area of the contact pieces 43 in this structure, the male terminal TA does not contact with the restraining section 51 upon inserting the male terminal TA. Accordingly, it is possible to downsize the female terminal hardware.

Although the louver terminal 40 includes two contact plates 41 and 42 in the above embodiment, this is not limited. For example, the louver terminal 40 may include a single contact plate, which is provided with a restraining section that restrains the louver terminal from being shifted to obtain an inserting space for the male terminal TA.

What is claimed is:

1. A female terminal hardware-comprising:

a terminal main body including a box-like terminal connecting section; and a louver terminal housed in said terminal connecting section and including contact pieces juxtaposed and extending in an inserting direction of a mating male terminal, and contact piece holding sections for holding said contact pieces;

said terminal connecting section being provided with a terminal containing section for housing said louver terminal and with a louver terminal inserting aperture extending into the terminal containing section in a direction transverse to the inserting direction for receiving said louver terminal;

said louver terminal being provided with a restraining section on a side area of said contact pieces, said restraining section restraining said louver terminal from being shifted and defining an inserting space for said male terminal, said restraining section being aligned substantially parallel to the inserting direction and being at a lateral side of the terminal connecting section.

2. The female terminal hardware of claim 1, wherein a portion of an inner wall of said terminal connecting section, on which said louver terminal is not disposed, is provided on both side areas of said louver terminal with projections extending along said inserting direction of said louver terminal.

3. The female terminal hardware of claim 1, wherein the contact piece holding sections include first and second opposed contact piece holding sections for holding first and second opposed arrays of said contact pieces, and wherein said restraining section connects the first and second contact piece holding sections.

4. The female terminal hardware of claim 1, wherein convex steps are provided on an inner wall of said terminal connecting section, and wherein said louver terminal has latches that engage with said steps.

5. The female terminal hardware of claim 1, wherein the terminal connecting section includes positioning apertures opposite the louver terminal inserting aperture, the louver terminal having positioning projections engaged in the positioning apertures.

6. The female terminal hardware of claim 1, wherein the louver terminal further comprises contact pieces extending from the contact piece holding sections and contacting an inner surface area of the terminal connecting section.

7. The female terminal hardware of claim 1, wherein the louver terminal further comprises a deflection restraining piece extending between the first and second opposed contact piece holding sections at a side of the louver terminal opposite the retraining section.

8. A female terminal hardware comprising:

a terminal main body formed from a conductive metal and including a box-like terminal connecting section with front and rear openings, the terminal connecting section having a louver terminal inserting aperture extending into a side wall of the terminal main body; and a louver terminal configured for insertion into the louver terminal insertion aperture and housed in said terminal connecting section, said louver terminal including first and second spaced apart contact piece holding sections, first and second spaced apart arrays of contact pieces supported respectively on the first and second contact piece holding sections and defining an inserting space for a mating male terminal between the first and second arrays of said contact pieces, each of said contact pieces extending in an inserting direction of the mating male terminal, a restraining section extending between and connecting the first and second contact piece holding sections, the restraining section being offset laterally from the inserting space of the mating male terminal and being aligned substantially parallel to the inserting direction.

9. The female terminal hardware of claim 8, wherein the louver terminal further comprises a deflection restraining piece extending between the first and second opposed contact piece holding sections at a side of the louver terminal opposite the retraining section.

10. The female terminal hardware of claim 9, wherein said louver terminal inserting aperture is provided on a side surface of said terminal connecting section between the front and rear openings, and wherein said restraining section is disposed at a side area of said louver terminal inserting aperture when said louver terminal is inserted into said terminal connecting section.

11. The female terminal hardware of claim 10, wherein said terminal connecting section has projections extending along inner surfaces forward and rearward of said louver terminal for positioning said louver terminal longitudinally in the terminal connecting section.

12. The female terminal hardware of claim 11, wherein convex steps are provided on an inner wall of said terminal connecting section, and wherein said louver terminal has latches that engage with said steps.

13. The female terminal hardware of claim 12, wherein the terminal connecting section includes positioning apertures opposite the louver terminal inserting aperture, the louver terminal having positioning projections engaged in the positioning apertures.

* * * * *